US009435232B2

(12) United States Patent
Kim

(10) Patent No.: US 9,435,232 B2
(45) Date of Patent: Sep. 6, 2016

(54) ELECTRONIC ACTIVE LOCK PIN CONTROL METHOD FOR MIDDLE PHASE TYPE CONTINUOUSLY VARIABLE VALVE TIMING SYSTEM

(71) Applicants: Hyundai Motor Company, Seoul (KR); Kia Motors Corporation, Seoul (KR)

(72) Inventor: Sung-Joo Kim, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 14/680,610

(22) Filed: Apr. 7, 2015

(65) Prior Publication Data

US 2016/0115829 A1 Apr. 28, 2016

(30) Foreign Application Priority Data

Oct. 27, 2014 (KR) ..... 10-2014-0146259

(51) Int. Cl.
*F01L 1/34* (2006.01)
*F01L 1/344* (2006.01)

(52) U.S. Cl.
CPC .... *F01L 1/3442* (2013.01); *F01L 2001/34426* (2013.01); *F01L 2001/34453* (2013.01)

(58) Field of Classification Search
CPC ..... F01L 2001/34423; F01L 2001/34426; F01L 2001/34453; F01L 2001/34456; F01L 2001/34459; F01L 2001/34463
USPC ..... 123/90.17
See application file for complete search history.

(56) References Cited

U.S. PATENT DOCUMENTS

2013/0104822 A1* 5/2013 Dupuis ..... F01L 1/3442 123/90.17

FOREIGN PATENT DOCUMENTS

| | | | |
|---|---|---|---|
| JP | 2000-170509 | A | 6/2000 |
| JP | 2002-227621 | A | 8/2002 |
| JP | 2005-264764 | A | 9/2005 |
| JP | 2006-90307 | A | 4/2006 |
| JP | 2011-163270 | A | 8/2011 |
| KR | 10-2010-0126447 | A | 12/2010 |
| KR | 10-2014-0002635 | A | 1/2014 |
| KR | 10-2004-0050307 | A | 6/2014 |
| KR | 10-2015-0058794 | A | 5/2015 |

* cited by examiner

*Primary Examiner* — Jorge Leon, Jr.
(74) *Attorney, Agent, or Firm* — Morgan, Lewis & Bockius LLP

(57) ABSTRACT

An electronic active lock pin control method may include checking whether a default position of a lock pin is present, determining whether the checked default position of the lock pin is due to lock pin parking or limphome, entering the default position of the lock pin into an active mode at a time of the lock pin default position by the lock pin parking, while entering the default position of the lock pin into a passive mode at a time of the lock pin default position by the limphome, and performing a phase control mode to track the middle phase type CVVT target value after the passive mode or the active mode.

6 Claims, 8 Drawing Sheets

ELECTRONIC ACTIVE LOCK PIN CONTROL METHOD FOR MIDDLE PHASE TYPE CONTINUOUSLY VARIABLE VALVE TIMING SYSTEM

CROSS-REFERENCE TO RELATED APPLICATIONS

The present application claims priority to Korean Patent Application No. 10-2014-0146259, filed Oct. 27, 2014, the entire contents of which is incorporated herein for all purposes by this reference.

BACKGROUND OF THE INVENTION

1. Field of the Invention

Various aspects of the present invention relate to a middle phase type continuously variable valve timing system (hereinafter, referred to as middle phase type CVVT), and more particularly, to a middle phase type continuously variable timing system using an electronic active lock pin control method which may improve target trackability of the middle phase type CVVT to a general CVVT engine level by performing lock pin unlocking and a phase control while generating a middle phase type CVVT target value.

2. Description of Related Art

Generally, middle phase type CVVT has rapider system responsiveness and a wider use area of a cam as compared with CVVT, by controlling a position of a cam at a middle position, not at a most retarded angle (intake) position and a most advanced angle (exhaust) position, when the middle phase type CVVT performs a control based on a difference between a target value and a current value of the cam, thereby improving the system responsiveness and fuel efficiency and reducing exhaust gas more than the CVVT.

In particular, the middle phase type CVVT uses an oil-flow control valve (OCV) which is installed at a lock pin side channel for a CVVT rotor which restricts a lock pin at the most advanced angle and the most retarded angle and a middle phase type oil-flow control valve (OCV) for a lock pin unlocking channel which unlocks the lock pin at the middle phase, thereby returning a mechanical default position based on a limphome mode while releasing an electronic lock pin by turning on/off a valve. Here, the limphome is a safe function of implementing minimum driving of a vehicle even when a problem of performance and a sensor operation arises.

However, the lock pin of the middle phase type CVVT controls an engine electronic control unit (ECU) using an electrical signal of the middle phase type OCV and thus needs a physical unlocking time after an electrical signal is applied to the valve and before the lock pin is unlocked.

Therefore, the middle phase type CVVT is first operated by supplying oil to the lock pin side channel of the middle phase type CVVT before the lock pin is unlocked, which generates a side-force of the rotor and the lock pin to lock the lock pin, thereby causing a physical lock-in phenomenon to prevent the lock pin from being unlocked.

In particular, the lock pin unlocking delay is developed to become a cam oscillation phenomenon of the middle phase type CVVT. Further, when the unlocking of the lock pin is not permitted, the middle phase type CVVT operation is not permitted, and as a result, drivability may deteriorate and an engine may stall.

An adverse effect due to the lock pin unlocking delay may be improved by performing a middle CVVT assist control for side-force offset after the lock pin is unlocked and then performing the middle phase type CVVT phase control, but a delay time from a timing at which the target value of the CVVT is generated to a timing at which the CVVT moves occurs at the middle phase type CVVT, and thus a reduction in power performance may not be completely solved.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a middle phase type continuously variable valve timing system using an electronic active lock pin control method which may minimize a lock pin unlocking delay time depending on limphome or normal lock pin parking by determining whether a default position of a lock pin 5 is due to limphome at the time of generating a middle phase type CVVT target value and then dividing the middle phase type CVVT into an active mode depending on a default position of a normal lock pin and a passive mode depending on a default position of a lock pin due to the limphome so as to perform a pre assist or an assist for unlocking of the lock pin and then perform a phase control depending on the middle phase type CVVT target value, in particular, may improve target trackability of the middle phase type CVVT to a general CVVT engine level by performing lock pin unlocking and the phase control while generating the middle phase type CVVT target value.

According to various aspects of the present invention, an electronic active lock pin control method may include (A) checking whether a default position of a lock pin is present, when a CVVT controller detects a generation of a middle phase type CVVT target value, (B) determining whether the checked default position of the lock pin is due to lock pin parking or limphome, (C) entering the default position of the lock pin into an active mode in which a lock pin unlocking delay is solved by applying a control duty of a middle phase type oil-flow control valve (OCV) at the time of the lock pin default position by the lock pin parking, while entering the default position of the lock pin into a passive mode in which the lock pin unlocking delay is solved by not applying the control duty of the middle phase type OCV supplying oil to a lock pin unlocking oil chamber in which the lock pin is accommodated at the time of the lock pin default position by the limphome, and (D) performing a phase control mode to track the middle phase type CVVT target value after the passive mode or the active mode.

In the active mode, (c-1a) a holding control duty may be applied to the middle phase type OCV and (c-2a) a flow of oil may be formed in a lock pin unlocking channel continued to the lock pin unlocking oil chamber due to the holding control duty and under an oil pressure condition by the flow of the oil, an oil pressure may be smaller than a lock pin unlocking pressure and thus the lock pin may be in a holding state under an action of the oil pressure, but the oil pressure may be larger than an operation pressure of a channel shut-off valve of a left channel shut-off valve at a left rotor channel of the OCV continued to a left lock pin oil chamber of the rotor and a right channel shut-off valve at a right rotor channel of the OCV continued to a right lock pin oil chamber to open the left and right channel shut-off valves so as to supply oil to the left lock pin oil chamber or the right lock pin oil chamber.

In the passive mode, (c-1b) the control duty may not be applied to the middle phase type OCV, a flow of oil may not be formed in a lock pin unlocking channel continued to the lock pin unlocking oil chamber due to the non-application of the control duty, under an oil pressure condition by the non-formation of the flow of the oil, an oil pressure may not be applied to the lock pin, but the oil pressure may be smaller than an operation pressure of a channel shut-off valve of a left channel shut-off valve at a left rotor channel of the OCV continued to a left lock pin oil chamber of the rotor and a right channel shut-off valve at a right rotor channel of the OCV continued to a right lock pin oil chamber to close the left and right channel shut-off valves so as to prevent oil from being supplied to the left and right lock pin oil chambers.

In the phase control mode, (d-1) an opening control duty may be applied to the middle phase type OCV and (d-2) a flow of oil may be formed in a lock pin unlocking channel continued to the lock pin unlocking oil chamber due to the opening control duty and under an oil pressure condition by the flow of the oil, an oil pressure may be larger than a lock pin unlocking pressure and thus the lock pin may be unlocked under an action of the oil pressure and the oil pressure may be larger than an operation pressure of a channel shut-off valve of a left channel shut-off valve at a left rotor channel of the OCV continued to a left lock pin oil chamber of the rotor and a right channel shut-off valve at a right rotor channel of the OCV continued to a right lock pin oil chamber to open the left and right channel shut-off valves so as to supply the oil to the left lock pin oil chamber or the right lock pin oil chamber.

According to various aspects of the present invention, a middle phase type continuously variable valve timing system using an electronic active lock pin control method may include left and right rotor channels provided in a CVVT cam and continued to left and right lock pin oil chambers which are each formed left and right, respectively, of a rotor moving by an action of an oil pressure, a lock pin unlocking channel continued to a lock pin unlocking oil chamber which accommodates the lock pin changed from locking to unlocking by the action of the supplied oil pressure and form lock pin unlocking branch channels which are branched and connected to the left and right rotor channels, respectively, an oil-flow control valve (OCV) producing an oil pressure in the left and right rotor channels, respectively, a middle phase type OCV producing the oil pressure in the lock pin unlocking channel, left and right channel shut-off valves mounted at a connected portion between the left and right rotor channels and the lock pin unlocking channel and opened by the oil pressure of the lock pin unlocking channel, and a CVVT controller configured to apply a control duty to the OCV, divide the control duty applied to the middle phase type OCV into a holding control duty and an opening control duty, and form the oil pressure in the lock pin unlocking channel to open the left and right channel shut-off valves at a time of the holding control duty.

A channel which is connected to the OCV and the middle phase type OCV to supply the oil may be branched from a main channel.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1A:
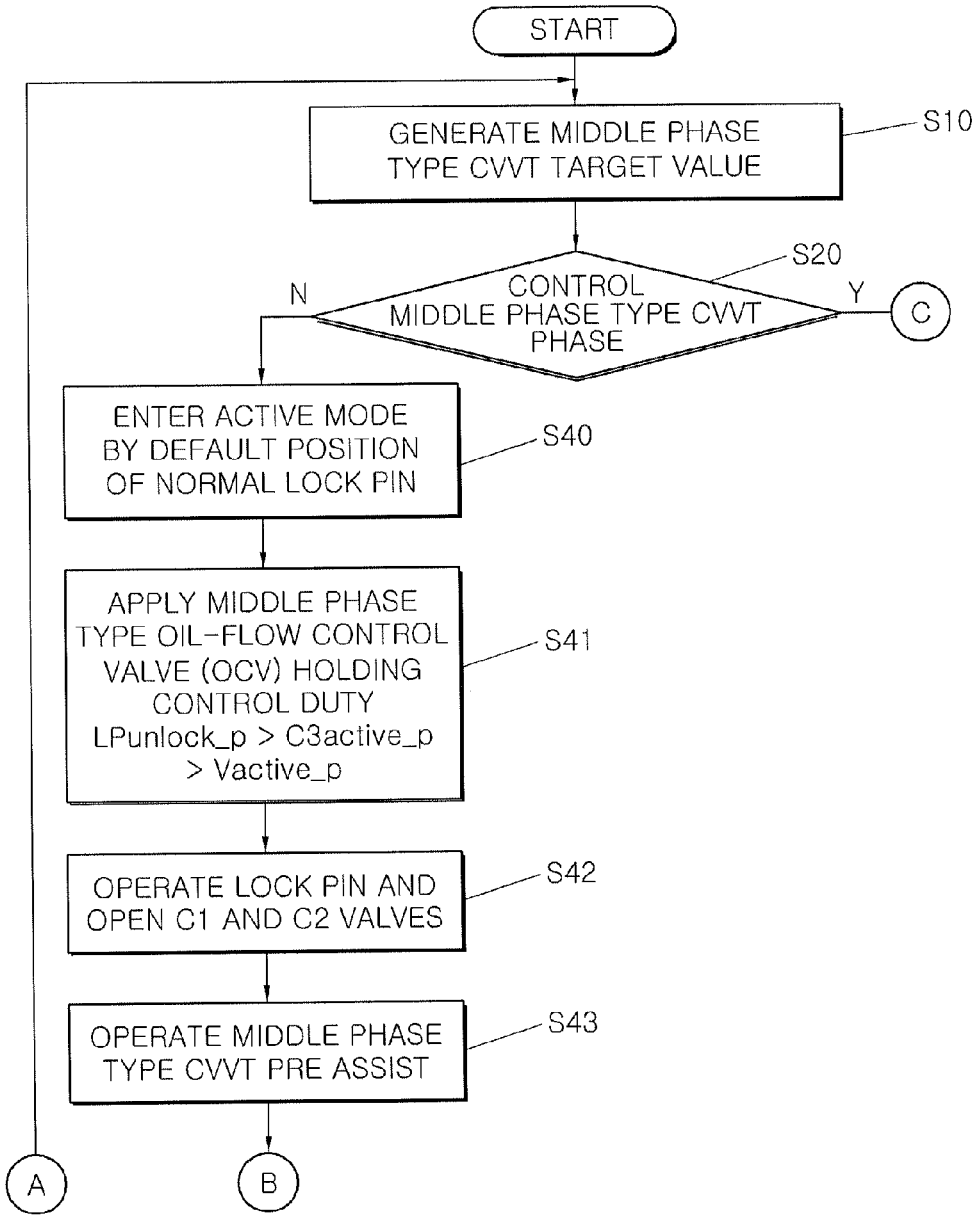
FIG. 1A and FIG. 1B are a flow chart of an exemplary electronic active lock pin control method according to an exemplary embodiment of the present invention.
Figure 1B:
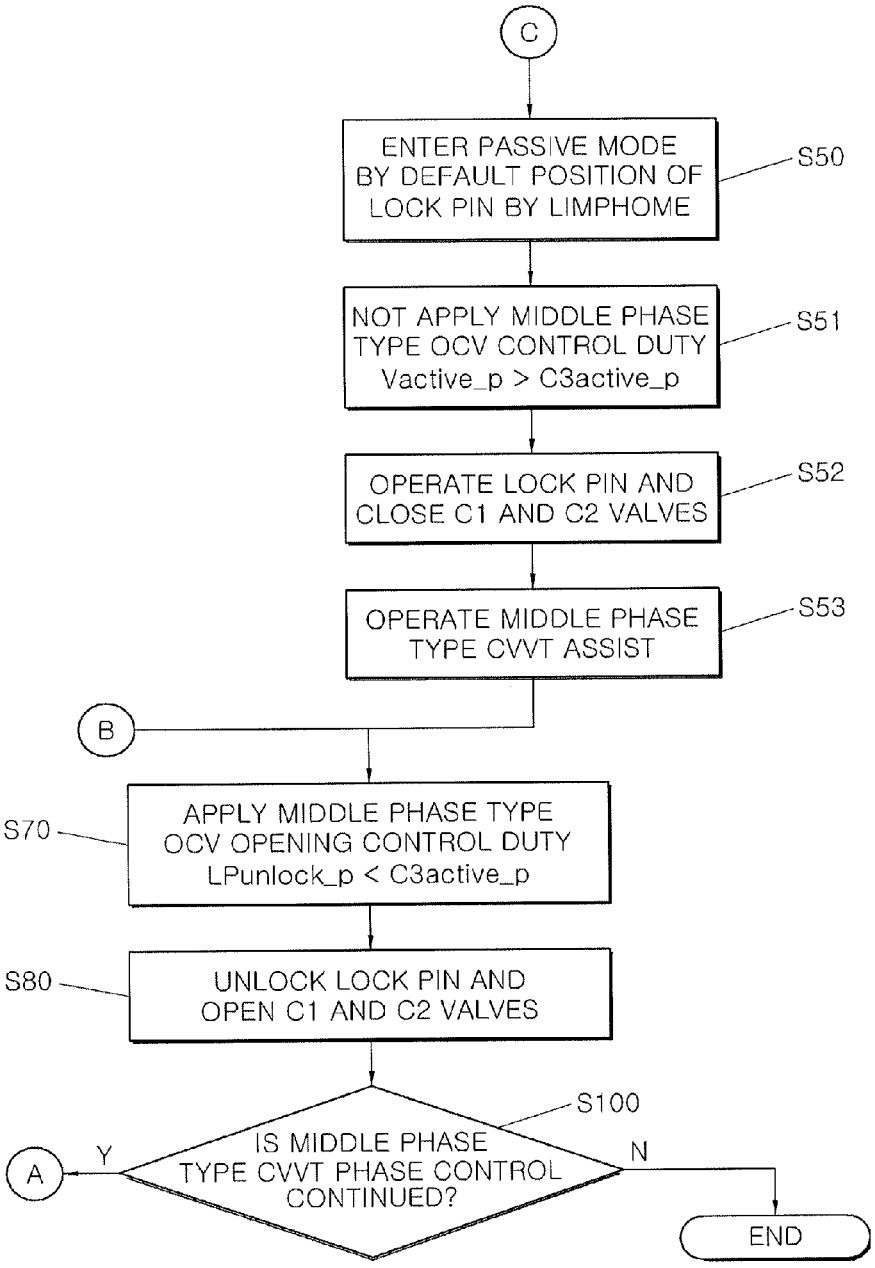

FIG. 1 A and FIG. 1B illustrate a flow chart of an electronic active lock pin control method in accordance with various embodiments of the present invention. As illustrated in FIG. 1A and FIG. 1B, when a middle phase type CVVT target value is generated in an electronic active lock pin control (S10), the control method determines whether to control the middle phase type CVVT phase (S20), for example, by determining whether a default position of a lock pin is due to limphome. Depending on the determination, the middle phase type CVVT is divided into an active mode depending on a default position of a normal lock pin (S40) and a passive mode depending on of the lock pin due to the limphome (S50). An active mode (S40) and a passive mode (S50) are implemented by a control of a middle phase type oil-flow control valve 30 and thus include a pair of channel shut-off valves 20-1 and 20-2 which are connected to the middle phase type OCV 30 at the middle phase type CVVT.

Figure 2:
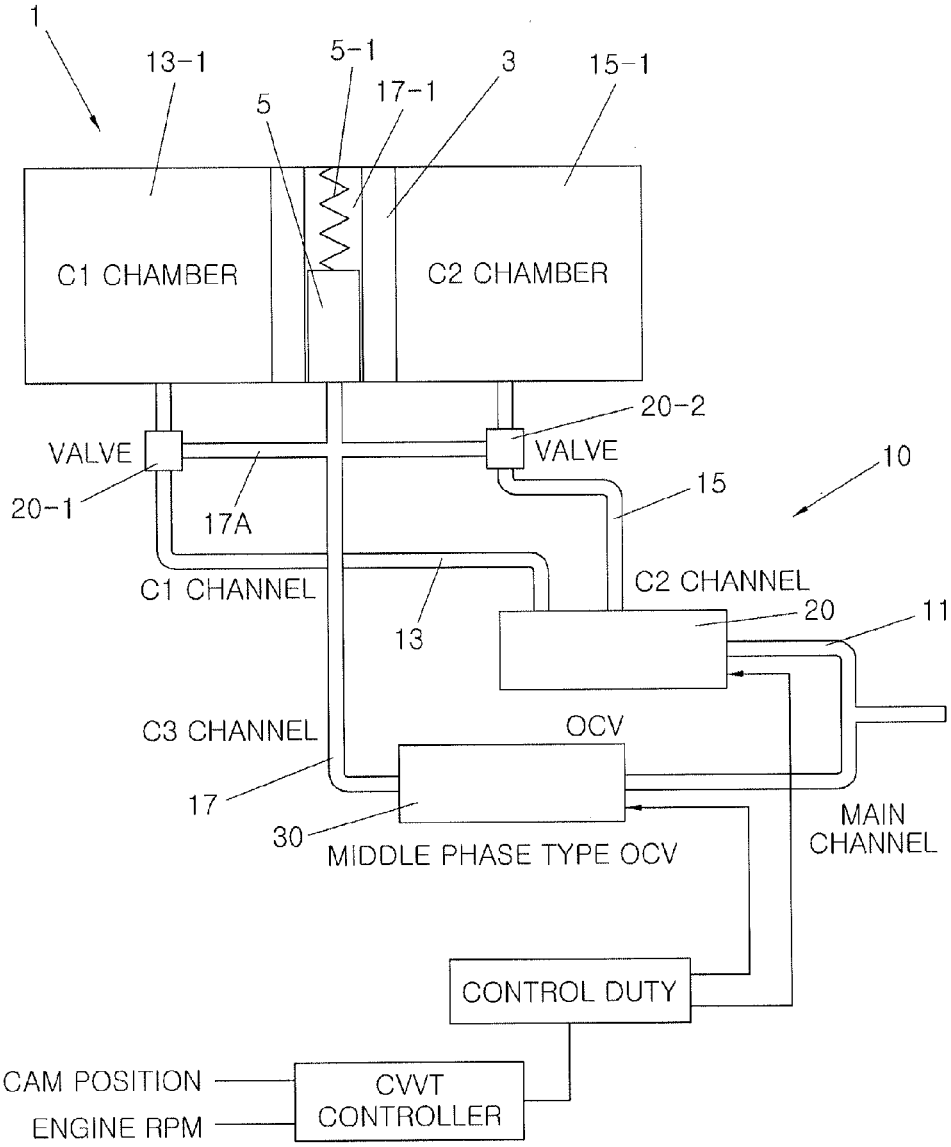
FIG. 2 is a configuration diagram of middle phase type CVVT at which the exemplary electronic active lock pin control method according to an exemplary embodiment of the present invention is implemented.

FIG. 2 illustrates detailed components of the middle phase type CVVT, in which the middle phase type CVVT includes a CVVT cam 1, a rotor 3, a lock pin 5, a hydraulic circuit 10, the oil-flow control valve (OCV) 20, the pair of channel shut-off valves 20-1 and 20-2, and the middle phase type OCV 30.

In detail, the CVVT cam 1 includes the rotor 3 and the lock pin 5, in which the rotor 3 implements a movement of a most advanced angle and a most retarded angle of the CVVT cam 1 based on left and right motions by a supply of oil and the lock pin 5 is connected to a return spring 5-1 providing a restoring force at the time of locking of the lock pin 5 after unlocking of the lock pin 5 while forming a side force with the rotor 3.

In detail, the hydraulic circuit 10 is configured to include a main channel 11 which is branched into the OCV 20 and the middle phase type OCV 30, respectively to supply engine oil, a pair of rotor channels 13 and 15 which is branched from the OCV 20 to be continued to left and right portions of the rotor 5 so as to supply oil for a motion of the rotor 5, and a lock pin unlocking channel 17 which has a lock pin unlocking branch channel 17A connected to the pair of rotor channels 13 and 15 while being continued from the middle phase type OCV 30 to the CVVT cam 1 so as to supply oil for unlocking of the lock pin 5. The pair of rotor channels 13 and 15 is divided into the left rotor channel 13 which is connected to a left lock pin oil chamber 13-1 formed at a left of the rotor 3 in the OCV 20 and a right rotor channel 15 which is connected to a right lock pin oil chamber 15-1 formed at a right of the rotor 3 in the OCV 20. The lock pin unlocking channel 17 is connected to a lock pin unlocking oil chamber 17-1 in which the lock pin is accommodated and the lock pin unlocking branch channel 17A is connected to the left rotor channel 13 and the right rotor channel 15 at a position before being connected to the lock pin unlocking oil chamber 17-1.

In detail, the OCV 20 is controlled by a control duty of a CVVT controller to supply oil of the main channel 11 to the left lock pin oil chamber 13-1 or the right lock pin oil chamber 15-1. Therefore, an oil supply direction of the OCV 20 generates the motion of the rotor 3 and the motion of the rotor 3 is changed to a movement of the most advanced angle and the most retarded angle of the CVVT cam 1.

In detail, the pair of channel shut-off valves 20-1 and 20-2 are configured to include the left channel shut-off valve 20-1 which is installed at the left rotor channel 13 to which the lock pin unlocking branch channel 17A is continued and the right channel shut-off valve 20-2 which is installed at the right rotor channel 15 to which the lock pin unlocking branch channel 17A is continued. In particular, the left channel shut-off valve 20-1 and the right channel shut-off valve 20-2 are opened and closed by an oil pressure of the lock pin unlocking channel 17.

In detail, the middle phase type OCV 30 is controlled by the control duty of the CVVT controller to supply the oil of the main channel 11 to the lock pin unlocking oil chamber 17-1. Therefore, the middle phase type OCV 30 supplies oil to unlock the lock pin 5 while controlling the opening and closing of the left channel shut-off valve 20-1 and the right channel shut-off valve 20-2. In particular, the middle phase type OCV 30 is binarized into a holding control which is controlled by an oil pressure holding the lock pin 5 while opening the left channel shut-off valve 20-1 and the right channel shut-off valve 20-2 and an opening control controlled by an oil pressure unlocking the lock pin 5 while opening the left channel shut-off valve 20-1 and the right channel cut-off valve 20-2.

Figure 3A:
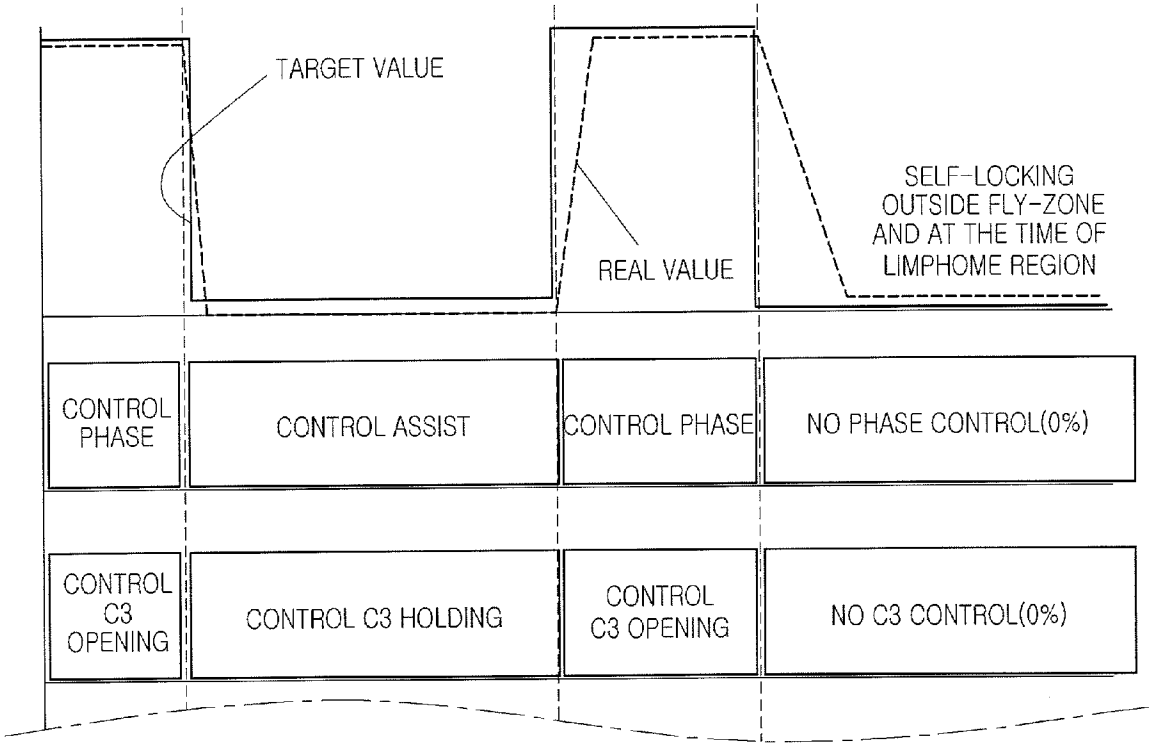
FIG. 3A and FIG. 3B are a pressure relationship diagram between a middle phase type oil-flow control valve (OCV) and a hydraulic circuit of the middle phase type CVVT depending on the electronic active lock pin control method according to an exemplary embodiment of the present invention.
Figure 3B:
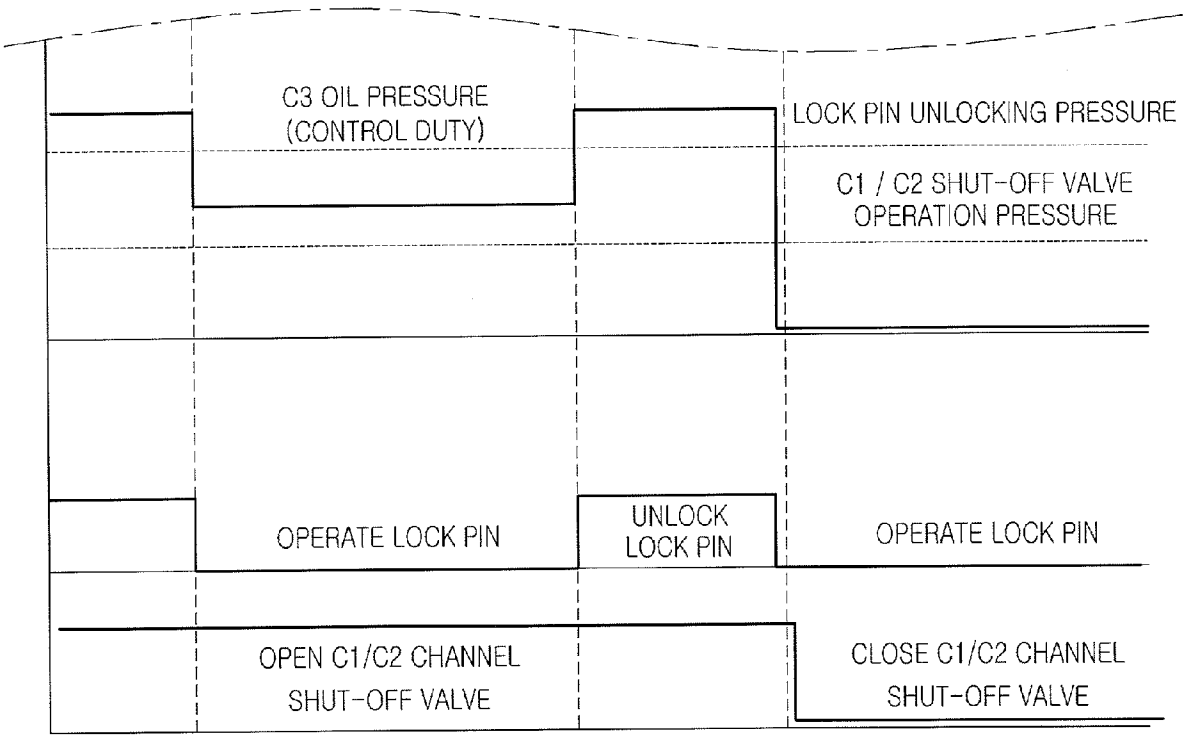

Hereinafter, the electronic active lock pin control method will be described in detail with reference to FIG. 1 A, FIG. 1B and FIG. 2. Here, the left rotor channel 13 is defined as a C1 channel, the right rotor channel 15 is defined as a C2 channel, the lock pin unlocking channel 17 is defined as a C3 channel, the left lock pin oil chamber 13-1 is defined as a C1 chamber, the right lock pin oil chamber 15-1 is defined as a C2 chamber, the left channel shut-off valve 20-1 is defined as a C1 valve, and the right channel shut-off valve 20-2 is defined as a C2 valve. Further, the oil pressure applied to the hydraulic circuit 10 is described based on a pressure size which is exemplified in an operation diagram of the middle phase type CVVT of FIG. 3A and FIG. 3B.

In detail, in connection with the generation of the middle phase type CVVT target value S10, the CVVT controller determines whether the default position of the lock pin is due to the limphome as in S20 and then the default position of the lock pin enters the active mode performed in a normal operation state of the middle phase type CVVT as in S40 or the default position of the lock pin enters the passive mode performed in an operation state of the limphome of the middle phase type CVVT as in S50.

In detail, when the default position of the lock pin enters the active mode of S40, as in S41, a holding control duty is applied to the middle phase type OCV 30 by the CVVT controller and the operation of the middle phase type OCV 30 by the application of the holding control duty operates the lock pin and opens the C1 and C2 valve as in S42 and thus the middle phase type CVVT is changed to a pre assist operation state as in S43. The pre assist operation state means the holding control and the oil pressure of the hydraulic circuit 10 has the following relationship.

The oil pressure of the hydraulic circuit: LPunlock_p>C3active_p>Vactive_p, in which the LPunlock_p is the lock pin unlocking pressure, the C3active_p is an oil pressure of the lock pin unlocking channel and the Vactive_p is an operation pressure of the channel shut-off valve.

Next, after the pre assist of S43 is operated, it proceeds to S70, and thus the middle phase type OCV 30 is controlled to be opened.

Figure 4:
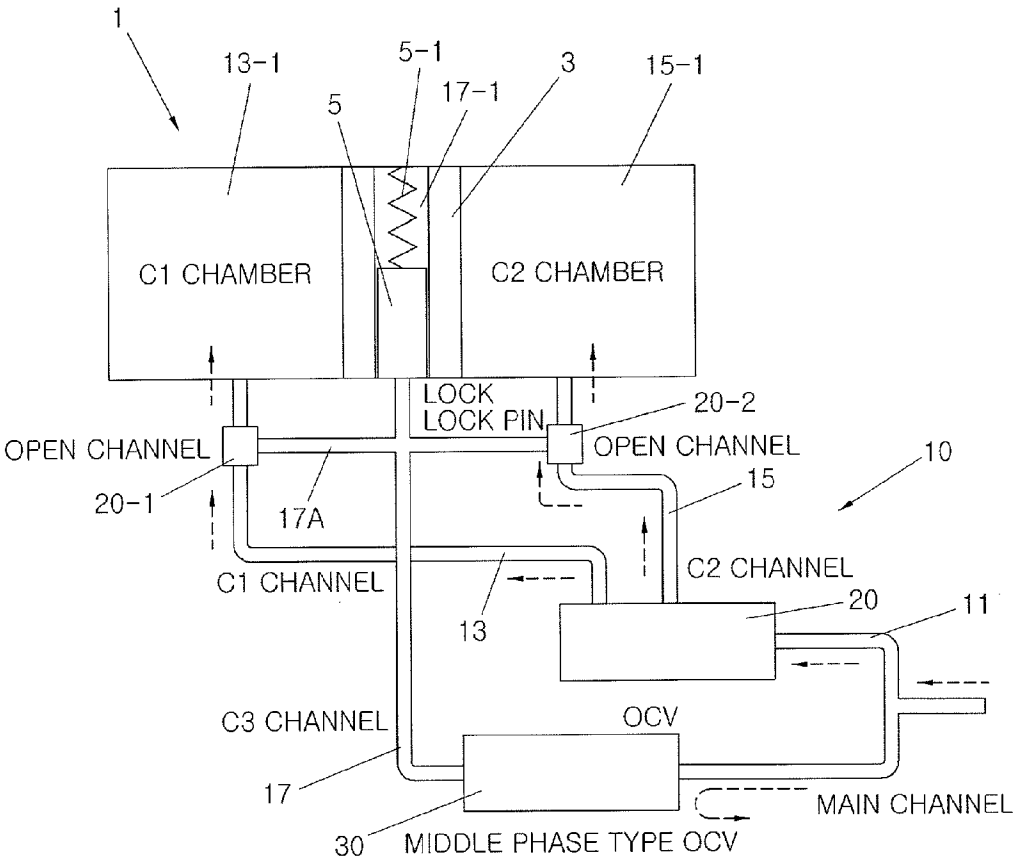
FIG. 4 is a diagram illustrating a state in which the middle phase type CVVT according to an exemplary embodiment of the present invention is operated as an active mode.

FIG. 4 illustrates the operation state of the middle phase type CVVT depending on the active mode of S40. As illustrated in FIG. 4, the CVVT controller applies the holding control duty to the middle phase type OCV 30 and applies the control duty to the OCV 20, such that the oil of the main channel 11 flows in the C1 and C2 channels 13 and 15 and the C3 channel 17. In this case, the C3active_p which is an oil pressure of the C3 channel 17 is larger than the Vactive_p which is the operation pressure of the channel shut-off valve, and thus the C1 and C2 valves 20-1 and 20-2 are opened while the oil is supplied to the lock pin unlocking oil chamber 17-1. On the other hand, the C3active_p which is an oil pressure of the C3 channel 17 is smaller than the LPunlock_p which is the lock pin unlocking pressure, such that the lock pin 5 is not unlocked and is in the holding state. Therefore, the locking of the lock pin 5 is held in the state in which oil is supplied to the C1 chamber 13-1 and the C2 chamber 15-1, and thus the middle phase type CVVT is controlled in the pre assist state in which only the assist control may be made while the phase control may not be made.

In detail, when the default position of the lock pin enters the passive mode of S50, as in S51, the control duty is not applied to the middle phase type OCV 30 by the CVVT controller and the non-operation of the middle phase type OCV 30 by not applying the control duty operates the lock pin and closes the C1 and C2 valve as in S52 and thus the middle phase type CVVT is changed to the assist operation state as in S53. The assist operation state means the control at the time of the limphome of the middle phase type CVVT and the oil pressure of the hydraulic circuit 10 has the following relationship.

The oil pressure of the hydraulic circuit: Vactive_p>C3active_p, in which the Vactive_p is the operation pressure of the channel shut-off valve and the C3active_p is the oil pressure of the lock pin unlocking channel.

Next, after the pre assist of S53 is operated, it proceeds to S70, and thus the middle phase type OCV 30 is controlled to be opened.

Figure 5:
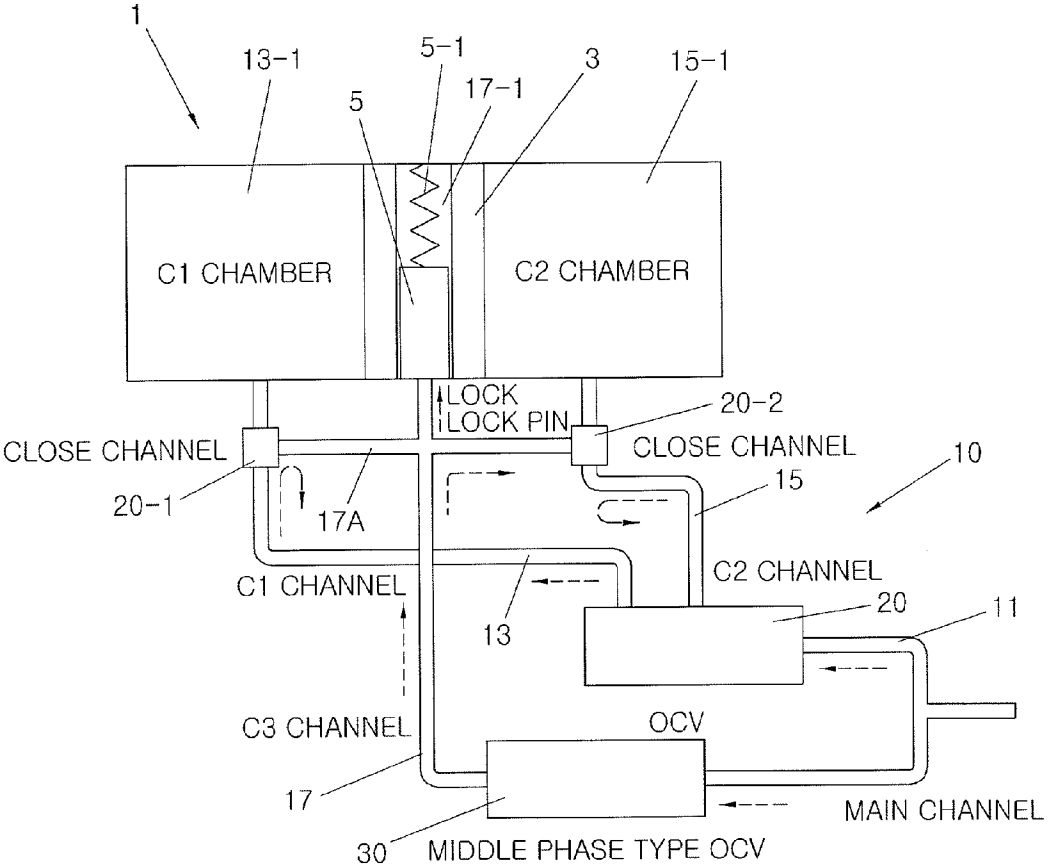
FIG. 5 is a diagram illustrating a state in which the middle phase type CVVT according to an exemplary embodiment of the present invention is operated as a passive mode.

FIG. 5 illustrates the operation state of the middle phase type CVVT depending on the passive mode of S50. As illustrated in FIG. 5, the CVVT controller does not apply the control duty to the middle phase type OCV 30 to prevent the oil of the main channel 11 from flowing in the C3 channel 17 and the C3active_p which is the oil pressure of the C3 channel 17 is smaller than the Vactive_p which is the operation pressure of the channel shut-off valve, and thus the C1 and C2 valves 20-1 and 20-2 are closed. Therefore, even though the control duty is applied to the OCV 20, the supply of oil of the main channel 11 to the C1 and C2 valves 20-1 and 20-2 is shut-off, and thus the oil is not supplied to the C1 chamber 13-1 and the C2 chamber 15-1. Therefore, the C1 channel 13 and the C2 channel 15 are shut-off while the lock pin is locked in the limphome state, and thus the problem of the occurrence of delay time of the lock pin 5 which reduces power performance from the timing at which the CVVT target value is generated to the timing at which the CVVT actually moves is solved.

In detail, when it proceeds to the phase control of the middle phase type CVVT of S70, the opening control duty is applied to the middle phase type OCV 30 by the CVVT controller and the operation of the middle phase type OCV 30 operates the lock pin and opens the C1 and C2 valves as in S80 by applying the opening control duty, such that the phase control is performed depending on the middle phase type CVVT target value of S10. In this case, the oil pressure of the hydraulic circuit 10 has the following relationship.

The oil pressure of the hydraulic circuit: C3active_p>LPunlock_p, in which the C3active_p is the oil pressure of the lock pin unlocking channel and the LPunlock_p is the lock pin unlocking pressure.

The middle phase type CVVT phase control method determines whether to continue the middle phase type CVVT phase control at S100. Depending on the determination, the control method ends or proceeds back to S10 as illustrated in FIGS. 1A and 1B.

Figure 6:
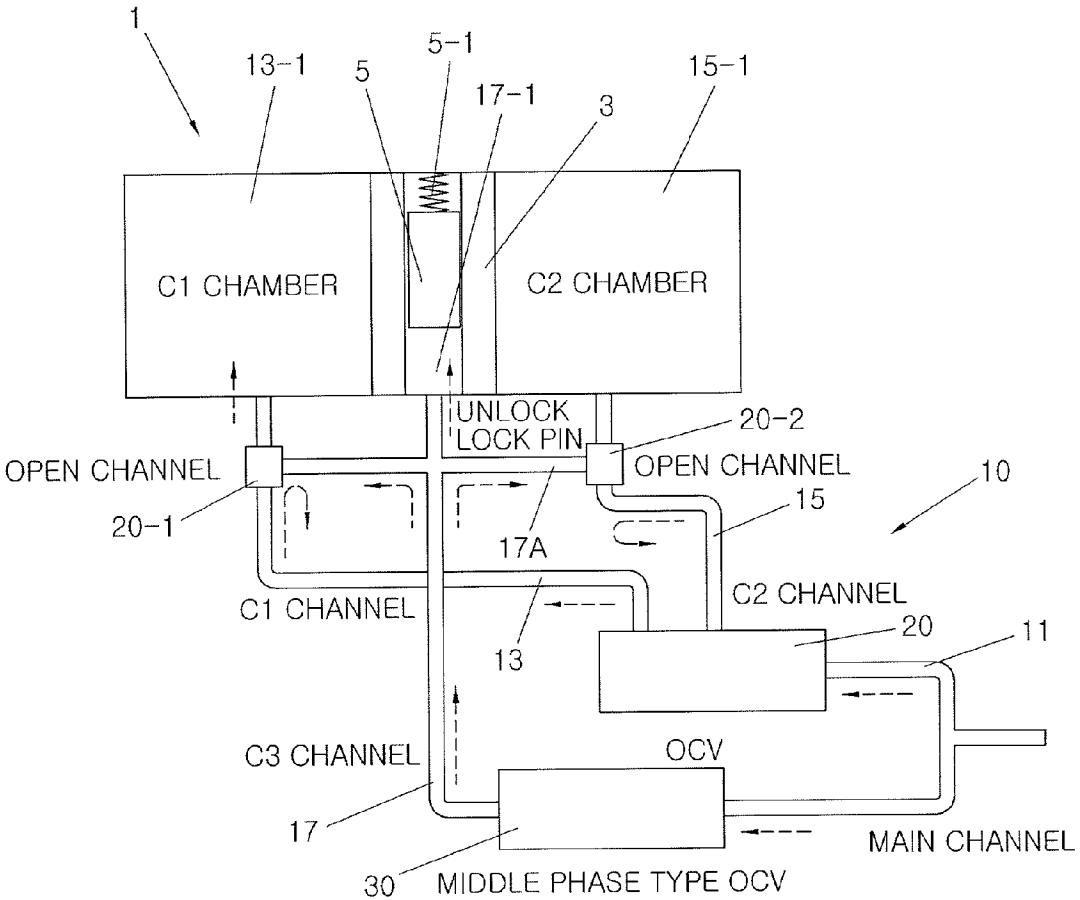
FIG. 6 is an operation state diagram of a phase control of the middle phase type CVVT according to an exemplary embodiment of the present invention.

FIG. 6 illustrates the operation state of the phase control of the middle phase type CVVT. As illustrated in FIG. 6, the CVVT controller applies the opening control duty to the middle phase type OCV 30 and applies the control duty to the OCV 20, such that the oil of the main channel 11 flows in the C1 and C2 channels 13 and 15 and the C3 channel 17. In this case, the C3active_p which is an oil pressure of the C3 channel 17 is larger than the Vactive_p which is the operation pressure of the channel shut-off valve, and thus the C1 and C2 valves 20-1 and 20-2 are opened while the oil is supplied to the lock pin unlocking oil chamber 17-1. Further, the C3active_p which is the oil pressure of the C3 channel 17 is larger than the LPunlock_p which is the lock pin unlocking pressure, such that the lock pin 5 is unlocked. Therefore, the middle phase type CVVT performs the phase control based on an advanced direction movement of the CVVT cam 1 which is associated with the motion of the rotor 5 by the oil supplied to the C1 chamber 13-1 or a retarded direction movement of the CVVT cam 1 which is associated with the motion of the rotor 5 by the oil supplied to the C2 chamber 15-1.

As described above, according to the middle phase type CVVT using the electronic active lock pin control method in accordance with various embodiments of the present invention, it is possible to increase the target trackability of the middle phase type CVVT to the general CVVT engine level by determining whether the default position of the lock pin 5 is due to the limphome at the time of generating the middle phase type CVVT target value and then dividing the middle phase type CVVT into the active mode depending on the default position of the normal lock pin and the passive mode depending on the default position of the lock pin due to the limphome so as to perform the pre assist or the assist for unlocking of the lock pin.

According to the middle phase type CVVT in accordance with various embodiments of the present invention, it is possible to improve the target trackability of the middle phase type CVVT depending on the generation of the middle phase type CVVT target value to the general CVVT engine level by implementing the pre assist for side-force offset of the lock pin and the rotor by controlling the control duty of the middle phase type OCV applied along with the OCV.

Further, in accordance with various embodiments of the present invention, it is possible to minimize the lock pin unlocking delay time depending on the limphome or the normal lock pin parking by determining whether the default position of the lock pin 5 is due to the limphome at the time of generating the middle phase type CVVT target value and then dividing the middle phase type CVVT into the active mode depending on the default position of the normal lock pin and the passive mode depending on the default position of the lock pin due to the limphome so as to perform the pre assist or the assist for unlocking of the lock pin and then perform the phase control depending the middle phase type CVVT target value.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electronic active lock pin control method, comprising:

(A) checking whether a default position of a lock pin is present, when a continuously variable valve timing (CVVT) controller detects a generation of a middle phase type CVVT target value;

(B) determining whether the checked default position of the lock pin is due to lock pin parking or limphome;

(C) entering the default position of the lock pin into an active mode in which a lock pin unlocking delay is solved by applying a control duty of a middle phase type oil-flow control valve (OCV) at a time of the lock pin default position by the lock pin parking, while entering the default position of the lock pin into a passive mode in which the lock pin unlocking delay is solved by not applying the control duty of the middle phase type OCV supplying oil to a lock pin unlocking oil chamber in which the lock pin is accommodated at a time of the lock pin default position by the limphome; and (D) performing a phase control mode to track the middle phase type CVVT target value after the passive mode or the active mode.

2. The method of claim 1, wherein in the (C), in the active mode:

(c-1a) a holding control duty is applied to the middle phase type OCV, and (c-2a) a flow of oil is formed in a lock pin unlocking channel continued to the lock pin unlocking oil chamber due to the holding control duty and under an oil pressure condition by the flow of the oil, an oil pressure is smaller than a lock pin unlocking pressure and thus the lock pin is in a holding state under an action of the oil pressure, but the oil pressure is larger than an operation pressure of a channel shut-off valve of a left channel shut-off valve at a left rotor channel of the OCV continued to a left lock pin oil chamber of the rotor and a right channel shut-off valve at a right rotor channel of the OCV continued to a right lock pin oil chamber to open the left and right channel shut-off valves to supply oil to the left lock pin oil chamber or the right lock pin oil chamber.

3. The method of claim 1, wherein in the (C), in the passive mode:

(c-1b) the control duty is not applied to the middle phase type OCV, a flow of oil is not formed in a lock pin unlocking channel continued to the lock pin unlocking oil chamber due to the non-application of the control duty, under an oil pressure condition by the non-formation of the flow of the oil, an oil pressure is not applied to the lock pin, but the oil pressure is smaller than an operation pressure of a channel shut-off valve of a left channel shut-off valve at a left rotor channel of the OCV continued to a left lock pin oil chamber of the rotor and a right channel shut-off valve at a right rotor channel of the OCV continued to a right lock pin oil chamber to close the left and right channel shut-off valves to prevent oil from being supplied to the left and right lock pin oil chambers.

4. The method of claim 1, wherein in the (D), in the phase control mode:

(d-1) an opening control duty is applied to the middle phase type OCV, and (d-2) a flow of oil is formed in a lock pin unlocking channel continued to the lock pin unlocking oil chamber due to the opening control duty and under an oil pressure condition by the flow of the oil, an oil pressure is larger than a lock pin unlocking pressure and thus the lock pin is unlocked under an action of the oil pressure and the oil pressure is larger than an operation pressure of a channel shut-off valve of a left channel shut-off valve at a left rotor channel of the OCV continued to a left lock pin oil chamber of the rotor and a right channel shut-off valve at a right rotor channel of the OCV continued to a right lock pin oil chamber to open the left and right channel shut-off valves to supply the oil to the left lock pin oil chamber or the right lock pin oil chamber.

5. A middle phase type continuously variable valve timing system using an electronic active lock pin control method, comprising:

left and right rotor channels provided in a continuously variable valve timing (CVVT) cam and continued to left and right lock pin oil chambers which are each formed left and right respectively, of a rotor moving by an action of an oil pressure;

a lock pin unlocking channel continued to a lock pin unlocking oil chamber which accommodates the lock pin changed from locking to unlocking by the action of the supplied oil pressure and form lock pin unlocking branch channels which are branched and connected to the left and right rotor channels, respectively;

an oil-flow control valve (OCV) producing an oil pressure in the left and right rotor channels, respectively;

a middle phase type OCV producing the oil pressure in the lock pin unlocking channel;

left and right channel shut-off valves mounted at a connected portion between the left and right rotor channels and the lock pin unlocking channel and opened by the oil pressure of the lock pin unlocking channel; and a CVVT controller applying a control duty to the OCV, dividing the control duty applied to the middle phase type OCV into a holding control duty and an opening control duty, and forming the oil pressure in the lock pin unlocking channel to open the left and right channel shut-off valves at a time of the holding control duty.

6. The system of claim 5, wherein a channel which is connected to the OCV and the middle phase type OCV to supply the oil is branched from a main channel.

* * * * *